US008230715B2

(12) United States Patent
Battenfeld et al.

(10) Patent No.: US 8,230,715 B2
(45) Date of Patent: Jul. 31, 2012

(54) HEAD OF PLIERS

(75) Inventors: Kurt Battenfeld, Ebsdorfergrund (DE); Thomas Glockseisen, Düsseldorf (DE)

(73) Assignee: WEZAG GmbH Werkzeugfabrik, Stadtallendorf (DE)

( * ) Notice: Subject to any disclaimer, the term of this patent is extended or adjusted under 35 U.S.C. 154(b) by 619 days.

(21) Appl. No.: 12/393,339

(22) Filed: Feb. 26, 2009

(65) Prior Publication Data

US 2009/0217791 A1 Sep. 3, 2009

(30) Foreign Application Priority Data

Mar. 1, 2008 (DE) ..... 10 2008 012 011

(51) Int. Cl.
*B25B 7/04* (2006.01)

(52) U.S. Cl. ..... 72/409.16; 72/409.11; 72/413

(58) Field of Classification Search ..... 72/409.1, 72/409.11, 409.14, 409.16, 409.06, 409.04, 72/409.08, 450; 29/270, 729, 758, 764; 81/421–423
See application file for complete search history.

(56) References Cited

U.S. PATENT DOCUMENTS

| | | | | |
|---|---|---|---|---|
| 671,835 | A * | 4/1901 | McTighe | 72/426 |
| 2,942,503 | A * | 6/1960 | Fitzgerald | 72/432 |
| 3,212,317 | A | 10/1965 | Lynch | |
| 3,406,558 | A * | 10/1968 | Tillmann et al. | 72/416 |
| 3,531,971 | A * | 10/1970 | Robb et al. | 72/385 |
| 3,611,782 | A * | 10/1971 | Eppler | 72/409.06 |
| 3,732,718 | A * | 5/1973 | Barberio et al. | 72/409.16 |
| 4,385,515 | A | 5/1983 | Link | |
| 4,660,241 | A | 4/1987 | Chen | |
| 4,794,780 | A | 1/1989 | Battenfeld | |
| 5,012,666 | A * | 5/1991 | Chen et al. | 72/409.01 |
| 5,153,984 | A * | 10/1992 | Beetz et al. | 29/751 |
| 5,187,968 | A | 2/1993 | Beetz et al. | |
| 5,228,325 | A * | 7/1993 | Wiebe et al. | 72/409.09 |
| 5,802,908 | A | 9/1998 | Frenken | |
| 5,913,933 | A | 6/1999 | Beetz et al. | |
| 6,026,566 | A * | 2/2000 | Urban et al. | 29/840 |
| 6,026,671 | A * | 2/2000 | Battenfeld | 72/409.12 |
| 6,053,025 | A | 4/2000 | Beetz et al. | |
| 6,155,095 | A | 12/2000 | Beetz | |
| 6,286,358 | B1 | 9/2001 | Beetz et al. | |

(Continued)

FOREIGN PATENT DOCUMENTS

DE 19 58 830 U 4/1967

(Continued)

OTHER PUBLICATIONS

European Search Report in related, co-pending Application No. EP 09153836, mailed May 20, 2009.

*Primary Examiner* — Edward Tolan
*Assistant Examiner* — Lawrence J Averick
(74) *Attorney, Agent, or Firm* — Thomas, Kayden, Horstemeyer & Risley, LLP

(57) ABSTRACT

The present invention relates to a head of crimping pliers for crimping a work piece. The head comprises two inserts. Each insert builds at least two halves of at least two nests for the work piece. The inserts are guided along a guiding axis for a sliding movement between a first and second relative position. The guiding axis is directed transverse to the crimping axis. Two nests built by the halves might be used in one and the same position by moving the inserts from the first to the second relative position.

18 Claims, 11 Drawing Sheets

U.S. PATENT DOCUMENTS

| | | | | |
|---|---|---|---|---|
| 6,289,712 | B1 | 9/2001 | Beetz et al. | |
| 6,474,130 | B2 | 11/2002 | Battenfeld | |
| 6,612,147 | B2 * | 9/2003 | Beetz et al. | 72/409.16 |
| 6,877,228 | B2 | 4/2005 | Beetz et al. | |
| 6,910,363 | B2 | 6/2005 | Beetz et al. | |
| 6,968,726 | B2 * | 11/2005 | Wang | 72/409.14 |
| 7,040,007 | B2 * | 5/2006 | Shutts et al. | 29/751 |
| 7,155,954 | B2 | 1/2007 | Battenfeld | |
| 2004/0055357 | A1 * | 3/2004 | Beetz et al. | 72/409.01 |
| 2006/0026824 | A1 | 2/2006 | Kramer | |
| 2009/0308132 | A1 * | 12/2009 | Lai et al. | 72/409.16 |

FOREIGN PATENT DOCUMENTS

| | | | |
|---|---|---|---|
| DE | 28 41 588 | C3 | 1/1982 |
| DE | 37 08 727 | C2 | 7/1988 |
| DE | 40 23 337 | C1 | 10/1991 |
| DE | 40 39 435 | C1 | 6/1992 |
| DE | 40 26 332 | C2 | 7/1992 |
| DE | 41 17 305 | C2 | 7/1994 |
| DE | 295 14 265 | U1 | 10/1995 |
| DE | 44 27 553 | C2 | 6/1998 |
| DE | 197 09 639 | A1 | 9/1998 |
| DE | 298 03 336 | U1 | 9/1998 |
| DE | 198 02 287 | C1 | 12/1998 |
| DE | 197 13 580 | C2 | 12/1999 |
| DE | 198 32 884 | C1 | 12/1999 |
| DE | 198 07 737 | C2 | 6/2000 |
| DE | 198 34 859 | C2 | 1/2001 |
| DE | 199 63 097 | C1 | 4/2001 |
| DE | 199 24 087 | C2 | 6/2002 |
| DE | 201 00 031 | U1 | 6/2002 |
| DE | 100 56 900 | C1 | 8/2002 |
| DE | 199 24 086 | C2 | 8/2002 |
| DE | 197 53 436 | C2 | 10/2002 |
| DE | 101 32 413 | C2 | 7/2003 |
| DE | 102 42 345 | B3 | 2/2004 |
| DE | 103 46 241 | B3 | 8/2004 |
| DE | 101 40 270 | B4 | 9/2004 |
| DE | 196 28 752 | B4 | 9/2004 |
| DE | 10 2007 001 235 | A1 | 7/2008 |
| DE | 86 04 624 | U1 | 3/2009 |
| EP | 0 471 977 | B1 | 6/1995 |
| EP | 1 231 027 | A2 | 8/2002 |

* cited by examiner

HEAD OF PLIERS

CROSS REFERENCE TO RELATED APPLICATIONS

This application claims priority to co-pending German Patent Application No. DE 10 2008 012 011.1 entitled "Zangenkopf", filed Mar. 1, 2008.

FIELD OF THE INVENTION

The present invention generally relates to a head for a crimping tool used for pressing or crimping (in the following "crimping") a work piece. Such work piece might be an electrical connection, a connection of tubes, a fitting, a cable shoe or the like.

BACKGROUND OF THE INVENTION

Conventional crimping tools have different kinematics and mechanics for their activation:

A first embodiment of crimping pliers of the applicant of the present patent application, see German Patent No. DE 37 08 727 C2 corresponding to U.S. Pat. No. 4,794,780, German Patent No. DE 197 53 436 C2 and German Patent No. DE 198 02 287 C1 corresponding to U.S. Pat. No. 6,053,025, uses hand levers and crimping jaws, wherein these hand levers and crimping jaws are pivoted in a common plane. The crimping jaws are pivoted with respect to a pivoting axis having an orientation perpendicular to the aforementioned plane. In an open state of the crimping pliers the crimping jaws build an opening angle so that it is possible to introduce a work piece into the head of the pliers built with the crimping jaws. Each crimping jaw supports a plurality of halves of nests. The halves of the nests are located one behind another in radial direction from the pivoting axis. Pairs of halves of the nests build a nest, wherein each nest has a contour correlating with the crimped contour of the work piece in a closed state of the crimping pliers. With a pivoting closing movement of the hand levers and the crimping jaws the halves of the nests get closer to each other and finally reach their closing position. According to German patent No. DE 37 08 727 C2, the halves of the nests are directly formed in the crimping jaws. Instead German Patents Nos. DE 197 53 436 C2 and DE 198 02 287 C1 disclose inserts, wherein a plurality of halves of nests is built in each insert. The inserts are separate from the crimping jaws and are exchangeably mounted with the crimping jaws.

Also for another embodiment of the applicant of the present patent application, see German Patent No. DE 40 23 337 C1 corresponding to U.S. Pat. No. 5,153,984, German Patent No. DE 44 27 553 C2, German Patent No. DE 198 32 884 C1 corresponding to U.S. Pat. No. 6,155,095, German Patent No. DE 100 56 900 C1 corresponding to U.S. Pat. No. 6,612,147, German Patent No. DE 101 32 413 C2 corresponding to U.S. Pat. No. 6,877,228, German Patent No. DE 101 40 270 B4, the hand levers and the crimping jaws move in a common plane. However, for these embodiments the pivoting relative movement of the hand levers is converted by a transfer mechanism into a translational movement of the crimping jaws. For these embodiments, the head comprises one fixed crimping jaw and one movable crimping jaw, wherein the movable crimping jaw has a translational degree of freedom versus the fixed crimping jaw along the longitudinal axis of the crimping pliers. Also for these embodiments the crimping jaws each comprise a plurality of halves of nests. Accordingly without any reconstruction or exchange of parts one and the same head might be used for crimping work pieces with different cross-sections and contours. For these embodiments the plurality of halves of the nests are positioned one besides another in transverse direction to the crimping axis, so in transverse direction to the translational degree of freedom of the movable crimping jaw. The head of the pliers is built with an O-shaped frame, wherein the upper transverse leg of the O-shaped frame correlates with the fixed crimping jaw. The movable crimping jaw is guided within the O-shaped frame for the translational movement along the side legs of the O.

Another embodiment is known from German Patent No. DE 197 13 580 C2 corresponding to U.S. Pat. No. 5,913,933, German Patent No. DE 198 07 737 C2 corresponding to U.S. Pat. No. 6,026,671, German "Gebrauchsmuster" DE 298 03 336 U1, German Patent No. DE 102 42 345 B3 corresponding to U.S. Pat. No. 6,910,363 and German Patent No. DE 197 53 436 C2. Here a movable crimping jaw comprising a plurality of halves of nests is moved along a translational degree of freedom versus a fixed crimping jaw. However, for this embodiment the head comprises a C-shaped frame, wherein the upper transverse leg of the C is fixedly connected with a fixed crimping jaw or a fixed insert.

Further embodiments of crimping pliers are known from German Patent Application No. DE 197 09 639 A1, German Patent No. DE 198 34 859 C2, German Patent No. DE 199 24 086 C2 corresponding to U.S. Pat. No. 6,286,358, German Patent No. DE 199 24 087 C2 corresponding to U.S. Pat. No. 6,289,712, German Patent No. DE 199 63 097 C1 corresponding to U.S. Pat. No. 6,474,130, German Patent No. DE 103 46 241 B3 corresponding to U.S. Pat. No. 7,155,954 and German Patent Application No. DE 10 2007 001 235 A1 corresponding to US Patent Application No. US 2008/0163664 A1. Here, the head of the pliers is used for crimping a fitting for tubes or sanitary systems. Also for these pliers the crimping jaws are pivoted with respect to a pivoting axis. However, these crimping jaws only have one single half of a nest for a fitting having a particular geometry.

Furthermore, German Patent No. DE 40 26 332 C2 corresponding to European Patent No. EP 0 471 977 B1 and German Patent No. DE 40 39 435 C1 corresponding to U.S. Pat. No. 5,187,968 of the applicant of the present patent application disclose crimping pliers having a nest being built at the front region of the head of the pliers. For these embodiments the work piece is introduced in longitudinal direction of the crimping pliers into the front region of the crimping pliers.

Furthermore, there are crimping tools, wherein the head of the crimping tool is not manually activated but activated by an external source, e.g. an electrical or hydraulic unit.

Also German "Gebrauchsmuster" No. DE 201 00 031 U1 discloses crimping pliers of the above mentioned type having crimping jaws pivoted around a pivoting axis. The crimping jaws hold exchangeable inserts each having a plurality of halves of nests with different contours and cross-sections. The crimping jaws have guiding protrusions used for guiding the inserts. In an operational position of the inserts such operational position is fixed by means of a resting sphere biased by a resting spring. In the operational position the resting sphere engages a resting groove of the inserts. One tool set is built with one crimping jaw and a plurality of inserts having halves of nests with differing geometries. The document cites background art with a case housing both the crimping pliers and the plurality of inserts. Instead DE 201 00 031 U1 suggests holding the inserts at the inner sides of the hand levers of the crimping tools and storing the inserts held by the hand levers until an exchange of the inserts for another work piece becomes necessary.

European Patent Application No. EP 1 231 027 A2 discloses a head for a crimping unit for connecting tubes. Here, the inserts activated throughout the crimping movement directly build the contact surfaces with the work piece. However, the document also suggests providing dove tale connections at the inserts for positively locking crimping jaws, wherein the inserts are fixed in their single operating state by a spring biased latching body. Furthermore, it is suggested both using contact surfaces for axially pressing the fitting and contact forces for radially pressing a fitting. Furthermore, the document suggests inserting the inserts in two orientations into the dove tale guidances.

German Patent No. DE 196 28 752 B4 (corresponding to U.S. Pat. No. 5,802,908) mentions as prior art German Patent No. DE 28 41 588 C3, German "Gebrauchsmuster" No. DE 19 58 830 U and German "Gebrauchsmuster" DE 86 04 624 U1 using a pair of rotatably supported crimping matrices in the shape of profiled wheels. The profiled wheels have at their periphery a plurality of halves of nests with differing geometries. The maximum number of halves of the nests with differing geometries is limited by the maximum diameter of the profiled wheel. In one single operating state the profiled wheels are locked by means of a spring biased bolt engaging the outer circumference of the profiled wheels. In modification of such background art, document DE 196 28 752 B4 suggests pivotably linking two separate rotatable crimping matrices with each of the crimping jaws. Such modification doubles the number of the halves of nests provided with one and the same crimping tool.

German Patent No. DE 41 17 305 C2 corresponding to U.S. Pat. No. 5,228,325 discloses crimping pliers having an upper die and a lower die, wherein the dies are rotatably supported by the crimping jaws with a rotational degree of freedom having an orientation parallel to the crimping axis.

SUMMARY OF THE INVENTION

It is an object of the present invention to provide a head of crimping pliers usable for work pieces of different types, diameters and/or contours.

The present invention bases on two findings:

For prior art cited above the number of halves of nests located at one single insert is limited by the extension of the insert correlating with the extension of the related crimping jaw.

Furthermore, for a plurality of fixed halves of nests the force conditions, the stresses and the deformations change with the change of the used nest. In case that the crimping jaws are pivoted around a pivoting axis the change of the used half of the nests changes the lever arm of the crimping force acting upon the crimping jaw. As a consequence the choice of a half having a distance from the pivoting axis being larger than the distance of another half of a nest from the pivoting axis requires that the user or another drive provides an increased force for providing one and the same crimping force at the nest. Furthermore, the aforementioned increase of the lever arm might lead to undesired deformations of the halves of the nests, the inserts and/or the crimping jaws deteriorating the precision of the crimping process.

In particular in case of the use of crimping jaws with a translational degree of freedom there is an optimal operational position for the nest housing the work piece. Such optimal operational position in general corresponds to the "force center" for applying the crimping force upon the crimping jaw. In the optimal case the resulting force of the crimping forces in the halves of the nests and the resulting force of the forces applied upon the crimping jaw are lying on the same axis such that these resulting forces do not produce a bending moment acting upon the crimping jaw. The use of a nest located offset from said "force center" leads to an additional bending moment acting upon the crimping jaw and/or the insert. Such additional bending moment might cause a deformation leading to a slanted orientation of the crimping jaws or inserts, additional stresses and a deviation of the final contour of the work piece at the end of the crimping process from the desired contour. In case of the aforementioned slanted orientation of the inserts and/or the crimping jaws the two end regions of a limiting contour of one half of a nest do not contact the corresponding end regions of the corresponding counter half of the nest at the end of the crimping process. Accordingly, the nest is not completely closed with a remaining gap of the nest between the opposing end regions of the halves of the nest. During the crimping process, material of the work piece might enter into such gap leading to undesired ridges or flashes at the end of the crimping process.

The present invention suggests not only providing one single operating state of the inserts. Instead, it is possible to move the inserts from a first relative position or operative state relative to the crimping jaws into at least one different second relative position or operational state. In the differing relative positions, it is possible to use different nests.

For the embodiments according to the invention, it might be possible that the number of halves located at one single insert is not limited by the longitudinal extension of the crimping jaw supporting the insert. According to the invention, it is possible that the insert extends beyond the supporting area of the crimping jaw such that the insert projects from the crimping jaws. Halves of the nests projecting in the first relative position from the crimping jaws should not be used in such first relative position due to insufficient support of such insert by the crimping jaws and due to a suboptimal force distribution. However, by moving the inserts relative to the crimping jaws into the second relative position or operational state these halves of the nests might be moved into the supporting area of the crimping jaws leading to a good support of these halves by the crimping jaws throughout the crimping process.

The transfer from the first relative position into the second relative position (and vice versa) is done by a translational movement. Such movement is directed transverse to a crimping axis of the crimping process. According to the invention, the inserts are guided along a guiding axis transverse to the crimping axis, wherein it is also possible that outside of distinct relative positions and without any further fixing device the translational sliding degree of freedom is withheld so that the use of the pliers and the change of the relative position is simplified.

According to the invention, the term "nest for a work piece" covers a "profile" or "nest". One entire nest is built with a first half formed by a first insert and a second half formed by the second insert. The inserts also cover embodiments, wherein the halves of the nests are built by an "upper profile part" and a "lower profile part". In particular in case of asymmetric halves of the nests being used, the inserts might also be built by a "crimp anvil" cooperating with a "plunger" or "punching tool".

In case of the first and second relative positions being chosen such that the operated first and second nest being approximately in the same position along the guiding axis transverse to the crimping axis, it is possible that the force conditions of the head of the pliers are more or less the same in the two positions when using the first and second nest. In particular in such case, the first and second relative positions lie on the axis running through the above mentioned "force center".

The use of the above mentioned advantages, i.e.

- the use of inserts with an increased number of halves of nests combined with the movement of a used half of the nest into the supporting area of the crimping jaw,
- the limitation of the change of the force conditions in the head of the pliers by use of different nests in the first and second relative position of the insert with respect to the crimping jaws, i.e. the use of the nests more or less in the same position, is not necessarily required. The advantages might also be used alternatively or cumulatively.

For another embodiment of the invention, the crimping jaws are impinged by forces being symmetrically to a symmetry axis. Such symmetry axis is an axis running through the aforementioned "force center" and resulting in a more or less zero bending moment caused by the crimping forces. The position that the first nest has in the first relative position and the position that the second nest has in the second relative position lie more or less on that symmetry axis. Such embodiment guarantees that there is no bending motion leading to a slanted orientation of the crimping jaws or the inserts. For embodiments according to documents DE 40 23 337 C1, DE 44 27 553 C2, DE 198 32 884 C1, DE 100 56 900 C1, DE 101 32 413 C2 and DE 101 40 270 B4 two pulling bars are used. One end region of each pulling bar is linked with a hand lever, whereas the opposite end region is directly or indirectly linked with a fixed crimping jaw. The symmetry axis of the pulling bars represent an axis where a half of a nest should be located for symmetrical stresses applied upon the insert and/or the crimping jaw during the crimping process. On the other hand for these embodiments also a pressure bolt pressing the movable crimping jaw versus the fixed crimping jaw is located on the aforementioned symmetry axis. For locating the half of the nest also on the symmetry axis, the pressure bolt as well as the resulting force at the movable half of the nest as well as the resulting force of the fixed half of the nest are approximately located on the symmetry axis of the pulling bars leading to an optimal force distribution, small or symmetric deformations, short lever arms and a centric location of the used nest.

In the sense of the present invention, "approximately at the same position" also covers some deviations from the above explained ideal positions. The amount of deviations still covered by the invention might in a first case be given by the existing plays of the components of the pliers. In case of an asymmetric contour of the halves of the nests being used, the geometric center of such contour might be shifted against the "ideal position", so that the "force center" of the resulting force of the asymmetric contour is approximately located at the "ideal position". Finally, also the location of the used half of the nest might be shifted with respect to the "ideal position" by an amount which is given by the tolerable asymmetry of the forces and the moments. The tolerable asymmetry might depend on the precision of the guidance of the crimping jaws, the stiffness of the components and/or further requirements concerning the precision of the crimped contour of the work piece at the end of the crimping process.

According to another embodiment of the invention, in the first and second relative positions there is still a sliding degree of freedom of at least one insert with respect to the crimping jaw. The sliding degree of freedom has an orientation transverse to the crimping axis. Such sliding degree of freedom might be given in a large scale so that the inserts might be more or less easily moved relative to the crimping jaws. However, it is also possible that the remaining degrees of freedom only exist to a small extent so that only small movements are possible. Such small movements might e.g. be used for a self-centering of the two halves of the nests throughout the crimping process. It is also possible that such a degree of freedom with a small extent is provided by a play of the components in the required direction. Furthermore, it is possible that the support of the insert by the crimping jaw has some elasticity along the degree of freedom so that despite of a fixation of the insert at the crimping jaw there is still some elasticity along the sliding degree of freedom for the self-centering effect.

Furthermore, it is possible that the head of the pliers comprises a fixing device securing the inserts in the first and second relative positions (and also in a plurality of additional relative positions). Accordingly, it is possible that the worker selects the first or second relative position in correlation with the dimensions and/or contour of the work piece to be crimped for the subsequent specific use of the first or second nest.

Such fixing device might be a mounting device, e.g. a securing bolt being fixed or screwed with the head of the pliers.

Furthermore, it is possible to use a fixing or adjusting screw having an orientation along the degree of freedom of the insert relative to the crimping jaw, wherein the change of the screwing of the fixing or adjusting screw with the components changes the position of the insert with respect to the crimping jaw along the sliding degree of freedom.

Furthermore, it is possible that the fixing device is a resting, latching or snapping device. In the sense of the invention, a resting device is a device providing a relative position building a stable equilibrium. For the use of the resting device, only the application of forces above a predetermined limit force leads to a change of the relative position between the insert and the crimping jaw, whereas for forces below such limit force the insert is returned into the relative position secured by the resting device. In a first embodiment, such resting device might be built with an elastically supported resting element engaging a resting groove or recess in the secured relative positions. As one example a resting sphere according to DE 201 00 031 U1 might be used. However, according to the invention such resting sphere does not only engage one single resting groove for providing one single operating state but engages a plurality of resting grooves in a plurality of operating states. By means of

- the geometry of the resting element and the contour of the resting groove or recess,
- the stiffness of the support of the resting element the resting behavior and the above mentioned limiting force might be designed and dimensioned. According to another embodiment of a fixing device, a resting device might magnetically secure a plurality of operating states.

However, it is also possible that the fixing device is a locking device. For such locking device it is not possible to leave a secured relative position only by application of a force acting along the sliding degree of freedom. Instead, it is necessary to unlock the locking device by an additional operation. According to one example, the locking device is built with a pawl positively engaging a locking recess. Leaving such secured operating state is only possible by manually moving the pawl out off engagement with the recess before initiating a relative movement between insert and crimping jaw. Without such additional manipulation of the locking device it is only possible to leave the secured relative position under destruction of the locking device.

For a simple embodiment of the invention, a guiding unit is built with a protrusion of the insert guided in a groove of the crimping jaw along the guiding axis. For dimensioning such guidance, such guidance has to provide a stiff support along the crimping axis, whereas the guidance does not supply any support along the guiding axis. The forces supported by the guiding unit transverse to the guiding axis and to the crimping axis are in general at least one dimension smaller than the forces acting along the crimping axis. Forces acting transverse to the crimping axis throughout the crimping forces in the halves of the nests are typically balanced by opposing forces in other regions of the contour of the same half of the nest. Accordingly also the forces that have to be supported by the fixing device are in general not very large. A guidance of a protrusion in a groove considers these force conditions in a very simple manner. Furthermore, for some embodiments it is possible to integrate a fixing, resting or locking device at least partially into the guidance built with the groove and the protrusion.

However, it might be of advantage to use the T-shapes only for securing the insert with respect to the crimping jaw for purposes not correlating with the crimping process itself, e.g. for the guidance of the movement between the relative positions, the avoidance of detaching the insert from the crimping jaw by a movement along the crimping axis and the like. An enhanced support throughout the crimping process is provided in case of using other large contact surfaces for transferring the crimping forces between the insert and the crimping jaw throughout the crimping process.

Furthermore, it is possible to use different sets of inserts each having a plurality of halves of nests with different contours and/or cross-sections. The head of the pliers according to the invention might build a tool set with other components of the crimping pliers as hand levers and a plurality of sets of inserts. However, it is also possible to fix at least one insert at one hand lever of the pliers. In a special embodiment such fixation is provided by introducing a protrusion (or a groove) of an insert into a groove (or protrusion) of a hand lever, see in general the disclosure of DE 201 00 031 U1, wherein also a fixing, locking or resting device might be used for fixing the position of the inserts at the hand lever.

The inventive design might be used at a head of pliers of any design, e.g. according to the different designs explained for the prior art mentioned above. To name only some examples, the invention might be used in connection with an O-shaped frame, wherein the O-shaped frame might be built with two parallel O-shaped plates and wherein the inserts are introduced between the two plates in lateral direction. According to another embodiment, the head of the pliers has a mouth open in lateral direction so that the inserts might be introduced into the mouth by lateral introduction. The inserts might be removed from the crimping jaws by reverting the relative movement between the insert and the crimping jaws. However, it is also possible that the inserts leave the mouth of the head of the pliers at the side opposing the side where the inserts have been introduced. According to another embodiment of the invention, the head of the pliers might be C-shaped in a first approximation, wherein the C extends in the plane in which the hand levers are moved. In such case, the inserts might be introduced into the head of the pliers along a guiding axis being directed perpendicular to the longitudinal axis of the crimping pliers that might correlate with the symmetry axis of the hand levers. Furthermore, the direction of the introduction of the inserts is parallel to the plane of the movement of the hand levers.

In case of the crimping process leading to crimping forces having an orientation perpendicular to the crimping axis or having at least a component in that direction, such forces lead to additional stresses of the components of the head of the pliers. Such forces might result from tolerances of the dimensions of the work piece at the start of the crimping process and/or an imprecise alignment of the halves of the nests. In case of a C-shaped head of the pliers, these forces might result in stresses along all of the legs of the C resulting in undesired deformations. Such additional stresses and/or deformations might be at least partially avoided in case of the inserts having a degree of freedom along the crimping axis for the crimping movement, but being directly or indirectly supported against each other. Accordingly, the aforementioned undesired transverse forces are not applied upon the whole head of the pliers but are directly supported at the location of their occurrence—so close to the inserts, crimping jaws and the operated nest.

One simple embodiment for a direct support of the inserts against each other is built by providing the inserts with recesses or bores having an orientation parallel to the crimping axis. A guiding bolt of the other insert or of a crimping jaw is located in the bore or recess. Such connection between a bore or recess and a guiding bolt builds a very simple design for providing a translational degree of freedom along the crimping axis but directly or indirectly supporting the inserts transverse to the crimping axis against each other. Another advantage of a guidance of the aforementioned type is that the inserts are coupled for a change from the first relative position to the second relative position by means of the guidance. Accordingly the two opposing inserts are moved as one single unit and fine adjustments of the relative positions of the inserts are not necessary in the plurality of operational states.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
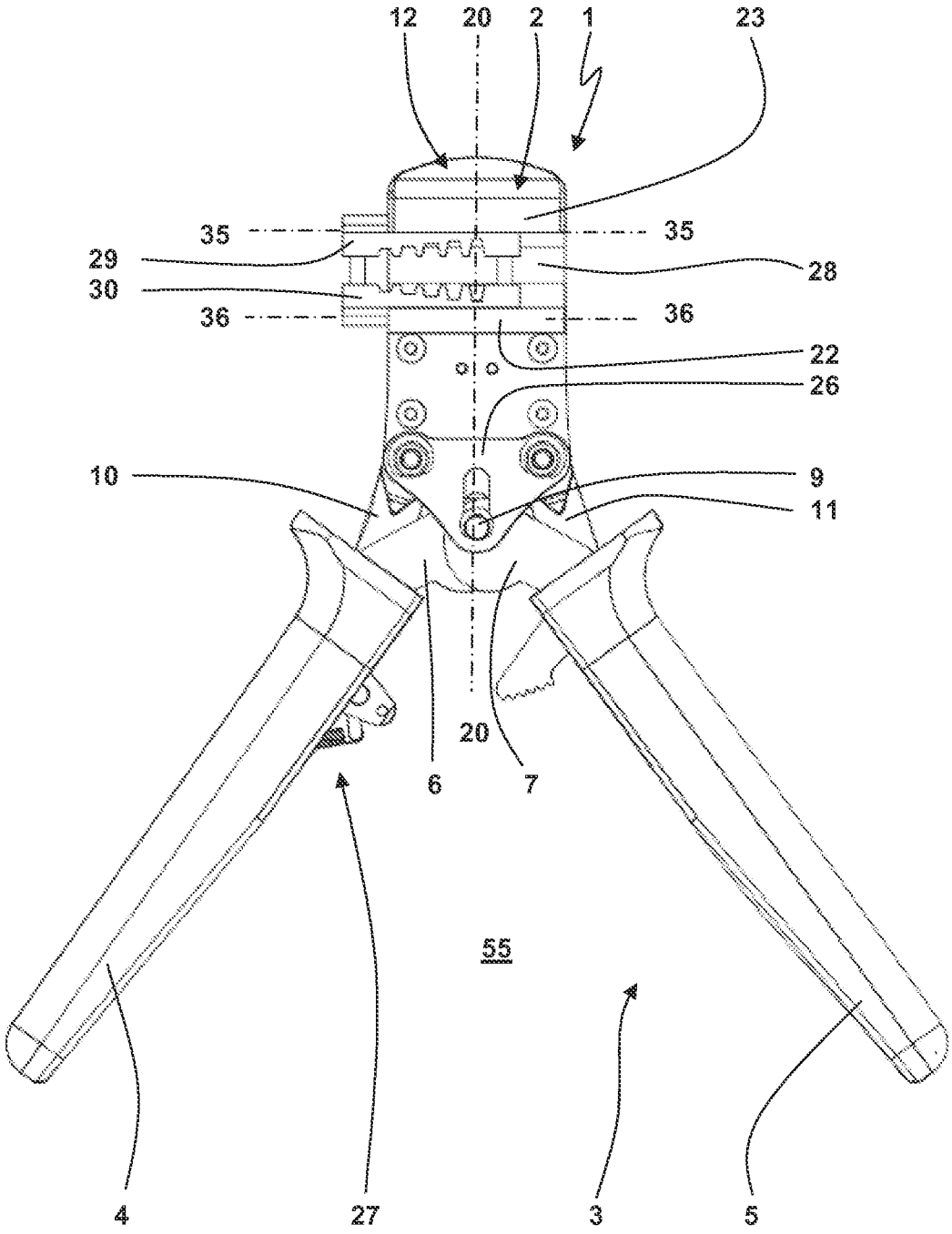
FIG. 1 is a plain view of crimping pliers with one embodiment of a head according to the invention in a partially disassembled and open state.
Figure 2:
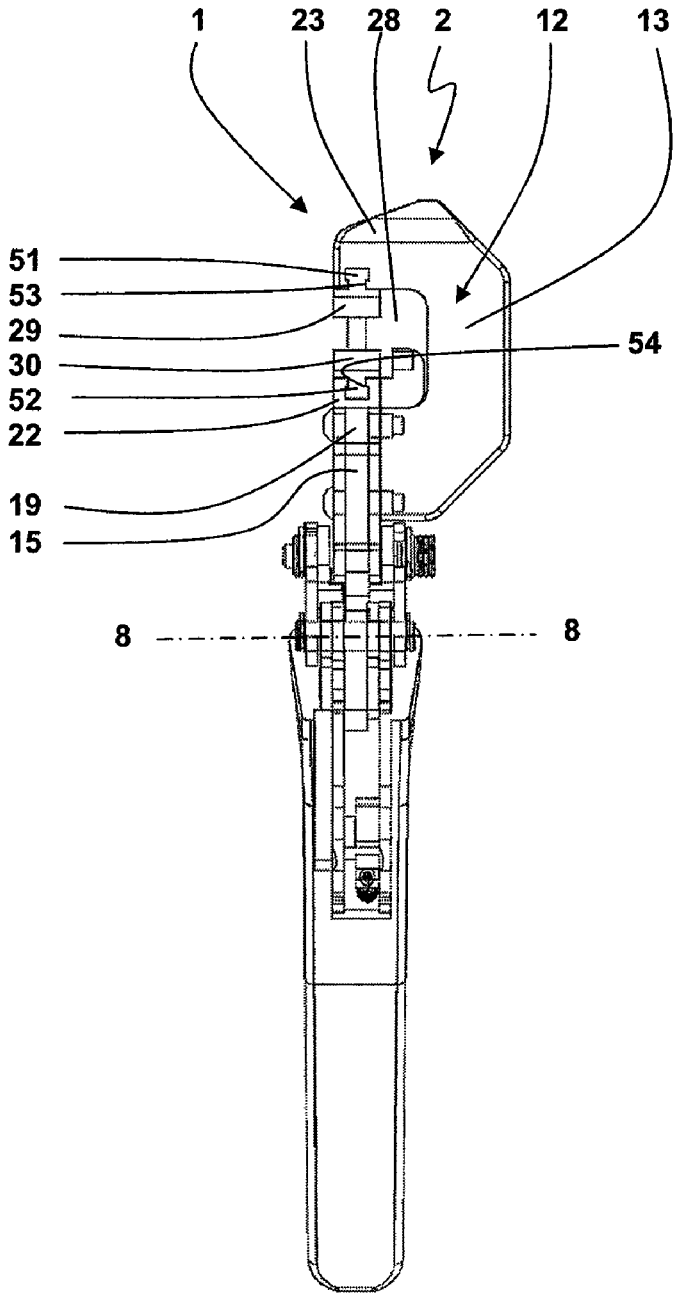
FIG. 2 is a side view of the crimping pliers according to FIG. 1 in an open state.

Referring now in greater detail to the drawings, FIGS. 1 to 4 show crimping pliers 1 having a head 2 and an activation part 3. The activation part 3 is built with two hand levers 4, 5. The hand levers 4, 5 are rigidly connected with linking regions 6, 7. In these linking regions 6, 7 the hand levers 4, 5 are pivotably linked with each other with a pivoting axis 8-8 having an orientation perpendicular to the drawing plane of FIG. 1. Such pivoting degree of freedom is provided by bores extending through the linking regions 6, 7. A pivoting bolt 9 extends through the bores. In the transitional region of the hand levers 4, 5 to the linking regions 6, 7 each of the hand levers 4, 5 is linked with an end region of a pulling bar 10, 11. The opposite end region of the pulling bars 10, 11 is linked at a frame 12 of the head 2. The frame 5 has a base body 13 having a cross-section which in a first approximation is C-shaped. The C-shaped cross-section extends in a plane having an orientation perpendicular to the drawing plane of FIG. 1. Accordingly, the C-shaped cross-section extends in a plane having an orientation parallel to the drawing plane of FIG. 2. In the end region of the lower transverse leg of the C the base body 13 is screwed with two supporting plates 15, 16 by screws 14. The supporting plates 15, 16 extend parallel to each other and build an intermediate space between guiding surfaces, wherein these guiding surfaces are built by the inner surfaces 17, 18 of the supporting plates 15, 16. As can be seen in the side view of FIG. 2, the frame 12 with the base body 13 and the supporting plates 15, 16 in a rough approximation builds the shape of a "question mark". The supporting plates 15, 16 are linked with the pulling bars 10, 11 in the bottom end region of the "question mark". Between the side surfaces 17, 18 a pushing element 19 is guided for a translational movement along a longitudinal axis 20-20 of the crimping pliers 1.

The linking regions 6, 7 are angled with respect to the hand levers 4, 5 or cranked or elbowed versus each other. In the end region facing the hand levers 4, 5, the pushing element 19 comprises a concavity 21 or recess. The pushing element 19 is from the upper side pressed against the bolt 9. In the end region opposite to the concavity 21, the pushing element 19 supports or carries a crimping jaw 22 having a translational degree of freedom or directly builds the crimping jaw 22 as an integral part of the pushing element. The fixed crimping jaw 23 is built by the upper transverse leg of the C of the frame 12. The pushing element 19 comprises at least one guiding groove 24 with a pin 25 located in the guiding groove 24. The pin 25 is fixedly linked with the frame 12. The pin 25 serves for limiting the maximum displacement of the pushing element 19 along the longitudinal axis 20-20. In an alternative or cumulative embodiment, the pin 25 is used for guiding the pushing element 19 along the longitudinal axis 20-20.

Figure 3:
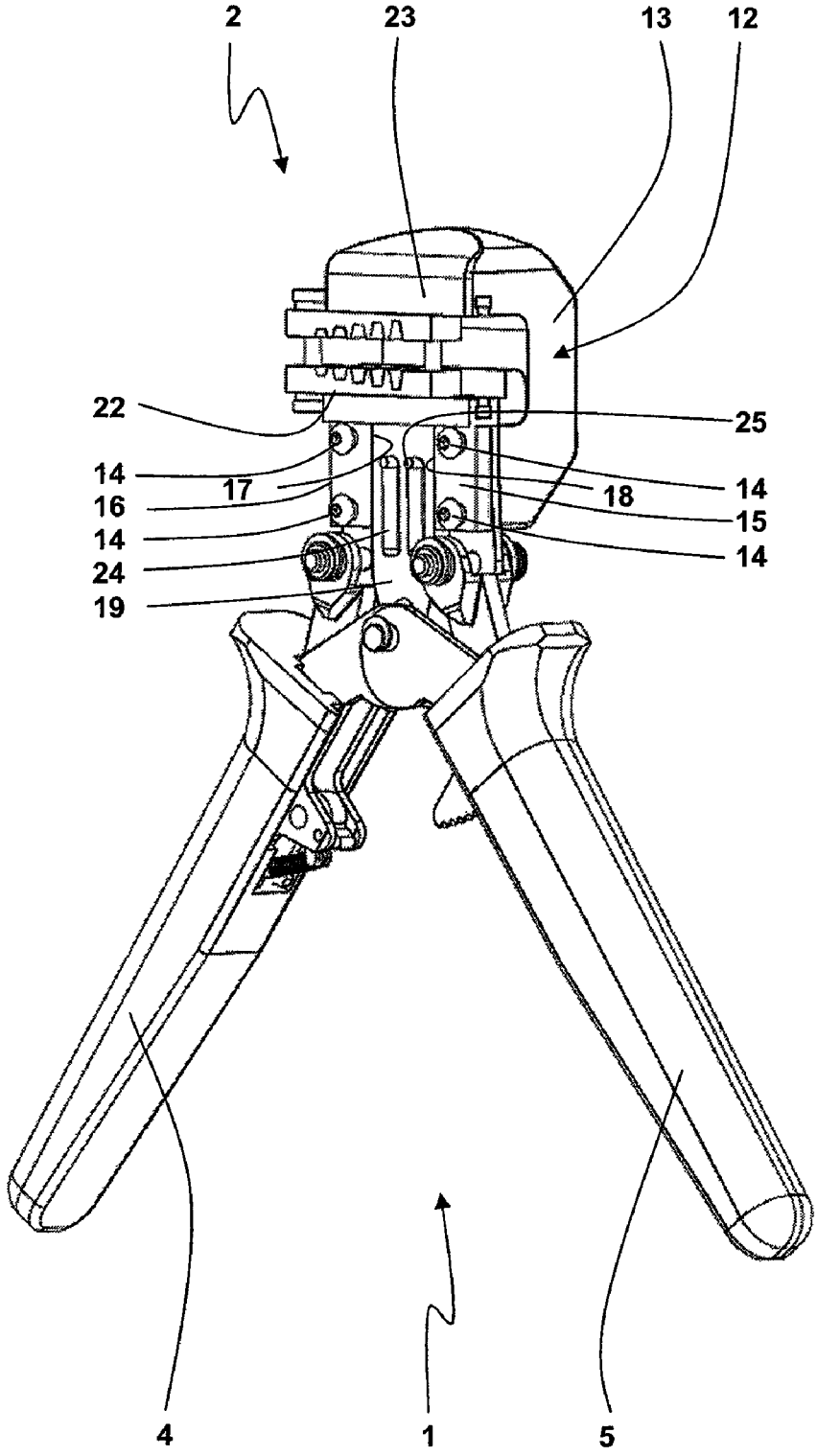
FIG. 3 is a three-dimensional view of the crimping pliers according to FIGS. 1 and 2 in a further disassembled and open state.

With a closing movement of the hand levers 4, 5 from the state shown in FIGS. 1 and 3, the bolt 9 is moved relative to the frame 12 along the longitudinal axis 20-20 in upper direction. This is caused by the linkage of the hand levers 4, 5 with the frame 12 via the pulling bars 10, 11. The bolt 9 transfers activating forces to the concavity 21 of the pushing element 19. These activating forces cause the closing movement of the pushing element 19 and the movement of the crimping jaws 22, 23 versus each other. For an exact guidance of the movement of the bolt 9, a guiding plate 26 might be used, see FIG. 1.

Furthermore, the crimping pliers 1 shown in the figures might have a forced locking unit 27 of any known type which is designed and arranged for securing a reached crimping step via a locking mechanism and automatically opens the crimping pliers when reaching the closed state, wherein such automatic opening is only possible when completely finishing the crimping movement.

As shown in FIG. 1, the C-shaped frame 12 has an opening 28 being open to the front side as well as to both lateral sides. Inserts 29, 30 extend in transverse direction to the longitudinal axis 20-20 and in horizontal direction in FIG. 1 within the opening 28. The inserts 29, 30 have crimping surfaces 31, 32 facing each other. Halves 33 of nests are formed in the crimping surfaces 31, 32, here five halves 33A, 33B, 33C, 33D and 33E. In a closed state of the crimping pliers 1, the crimping surfaces 31, 32 contact each other. In such closed state, pairs of the halves 33 of the inserts 29, 30 build nests 50A, 50B, 50C, 50D and 50E having different contours for the crimped work piece, e.g. with a hexagonal cross-section with differing diameters or differing contours.

Figure 4:
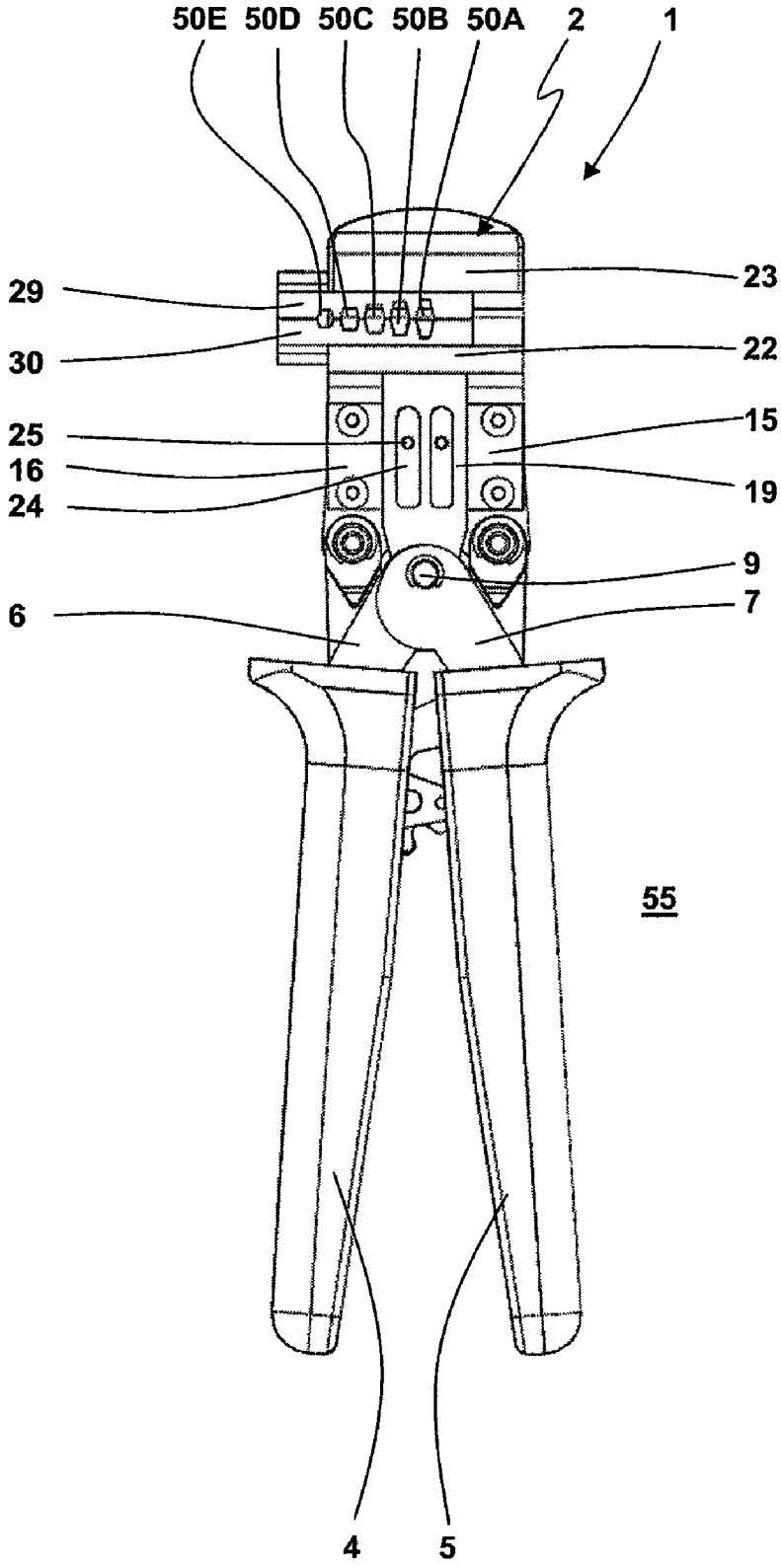
FIG. 4 is a plain view of the crimping pliers according to FIGS. 1 to 3 in a closed state.

In FIG. 4 the halves 33A of the inserts 29, 30 and the nest 50A built by the halves 33A are located in a first relative position. In this first relative position, the halves 33A and the nest 50A are located in the "force center" or are located at the longitudinal axis 20-20. A use of another half 33B (or 33C-33E) and another nest 50B (or 50C-50E) built by these halves in the shown first relative position would cause asymmetrical stresses as explained above. For a use of another half 33B (or 33C-33E) and a nest 50B (or 50C-50E) built by these halves, the inserts 29, 30 are moved along a translational degree of freedom transverse to the longitudinal axis 20-20 into a second relative position. In the second relative position, the halves 33B (or 33C-33E) and the nest 50B (or 50C-50E) to be used is located on or near the longitudinal axis 20-20 or the "force center", i.e. a position at least close to the position of the nest 50A in the first relative position.

One of the inserts 29 (or 30) comprises two bores having an orientation parallel to the longitudinal axis 20-20. The other insert 30 (or 29) carries two guiding bolts 34 extending through and being guided by the aforementioned bores. However, it is also possible that each of the inserts 29, 30 comprises one single bore and carries one bolt 34. A guiding unit built by the guiding bolts 34 and the bores is designed and arranged such that the inserts 29, 30 are directly guided for a translational relative movement along the crimping axis or longitudinal axis 20-20, whereas a relative movement of the inserts 29, 30 transverse to the longitudinal axis 20-20 is impossible due to the contact surfaces built by the outer circumference of the guiding bolts 34 and the inner cylindrical surface of the bores.

Opposite to the crimping surfaces 31, 32, the inserts 29, 30 comprise protrusions 51, 52 extending along the entire length of the inserts 29, 30. The protrusions 51, 52 are guided in related guiding grooves 53, 54 of the crimping jaws 22, 23. The protrusions 51, 52 are guided in the guiding grooves 53, 54 such that the inserts 29, 30 are rigidly supported in the direction of the crimping axis, whereas a sliding movement is guided transverse to the crimping axis 37 and in horizontal direction according to FIG. 1. For the embodiment shown in FIGS. 1 to 5, the protrusions 51, 52 have a T-shaped cross-section and are housed in corresponding T-shaped guiding grooves 53, 54. However, differing from the shown and described embodiment any other suitable type of a longitudinal guiding unit might be used for guiding the inserts 29, 30 with respect to the crimping jaws 22, 23. It is also possible that the protrusions 51, 52 do not extend along the entire length of the inserts. Instead, only two or more "discrete" protrusions might be used at one single insert, wherein these two or more discrete protrusions are also introduced into the guiding grooves 53, 54. According to another embodiment, the guiding bolts 34 are fixedly linked with one of the inserts 29, 30. In this embodiment, the bolts 34 protrude at each side of the inserts 29, 30. The end of the guiding bolt 34 facing the other insert 30, 29 is used for guiding the insert 29 in a bore of the insert 30. The other end of the guiding bolt 34 facing the crimping jaw enters the guiding groove 53, 54 of the crimping jaw. The protrusions 51, 52 and the guiding grooves 53, 54 might have any cross-section. According to another embodiment, the crimping forces during the crimping process are supported by a contact surface at the side of the inserts opposite to the crimping surfaces 31, 32 extending besides the protrusions. These contact surfaces contact related counter contact surfaces of the crimping jaws 22, 23. The guiding grooves 53, 54 build guiding axes 35-35 and 36-36. The inserts 29, 30 are guided for a sliding movement along these guiding axes 35-35 and 36-36 with a translational degree of freedom relative to the crimping jaws 22, 23. The crimping movement 37 correlating with the pivoting movement of the hand levers 4, 5 versus each other is directed transverse to the guiding axes 35-35, 36-36. The crimping movement 37, the guiding axes 35-35, 36-36 and the longitudinal axis of the groove-like halves 33 of the nests build an orthogonal coordinate system.

Figure 5:
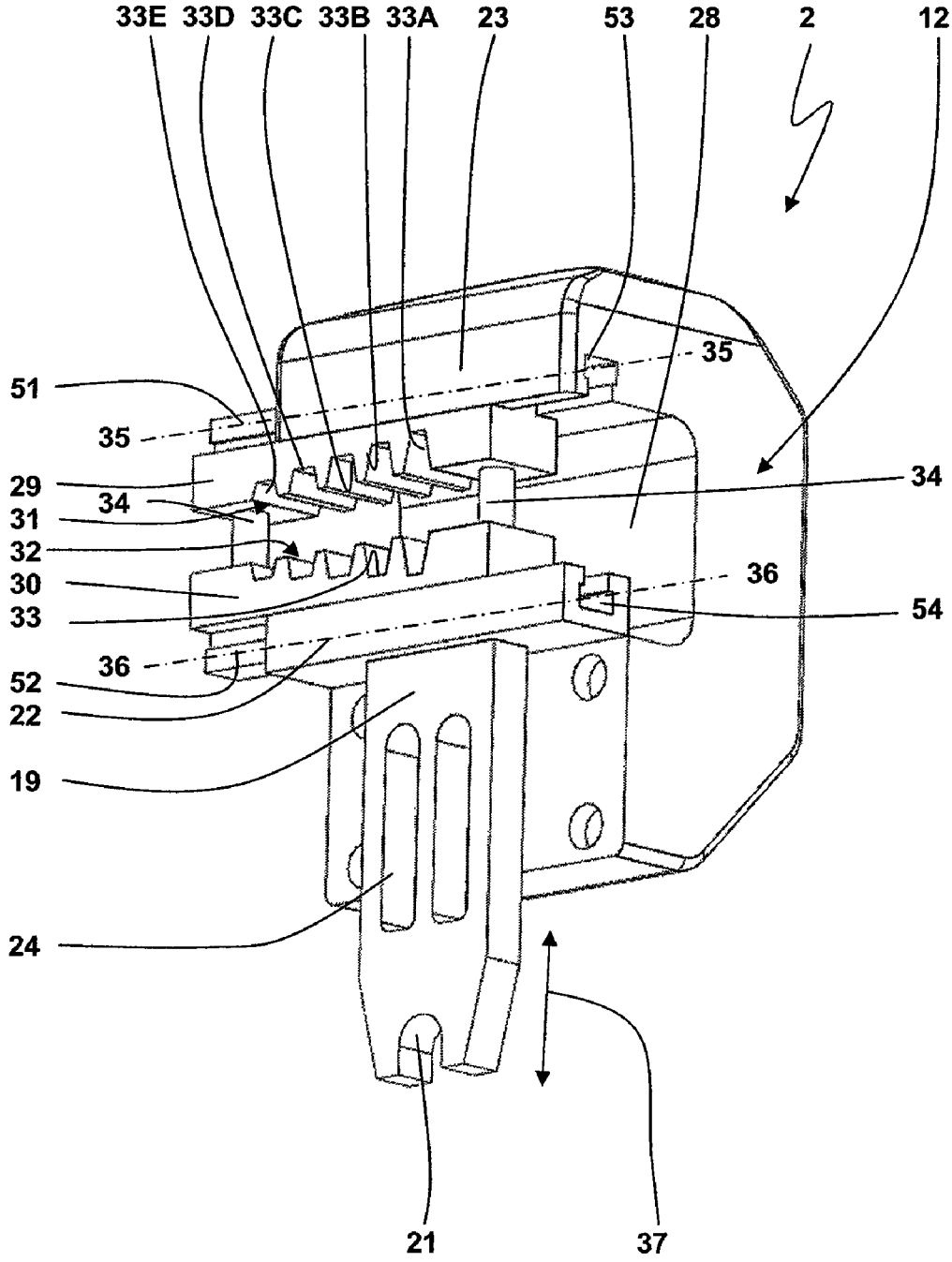
FIG. 5 is an enlarged three-dimensional view of a head according to the invention in partially disassembled state.

For the position shown in FIG. 5, the halves 33 that are located at the right hand side of FIGS. 1, 3, 4 and 5 are used because these halves are located close to the longitudinal axis or symmetry axis 20-20. For the use of another half 33 for another work piece, the unit built with the inserts 29, 30 is moved to the right hand side in FIGS. 1, 3, 4 and 5. The distance of the required move of the unit corresponds approximately with the distance of the centers of the halves 33. Differing from the shown embodiments, it is also possible to introduce the aforementioned unit in an orientation rotated by an angle of 180° around the longitudinal axis 20-20 or vertical axis. However, such rotation is not mandatory for using all of the halves 33 of the unit. Furthermore, it is possible that a stop element is provided for avoiding that the unit built with the inserts 29, 30 falls out off one side of the head 2.

For further embodiments of the invention described in the following, the same reference numerals are used for components having a function and/or geometry similar to components of the embodiment shown in FIGS. 1 to 5. However, the letter a (embodiment FIGS. 6 to 8) and b (embodiment FIGS. 9 to 10) has been amended to these reference numerals for distinguishing the different embodiments.

Figure 6:
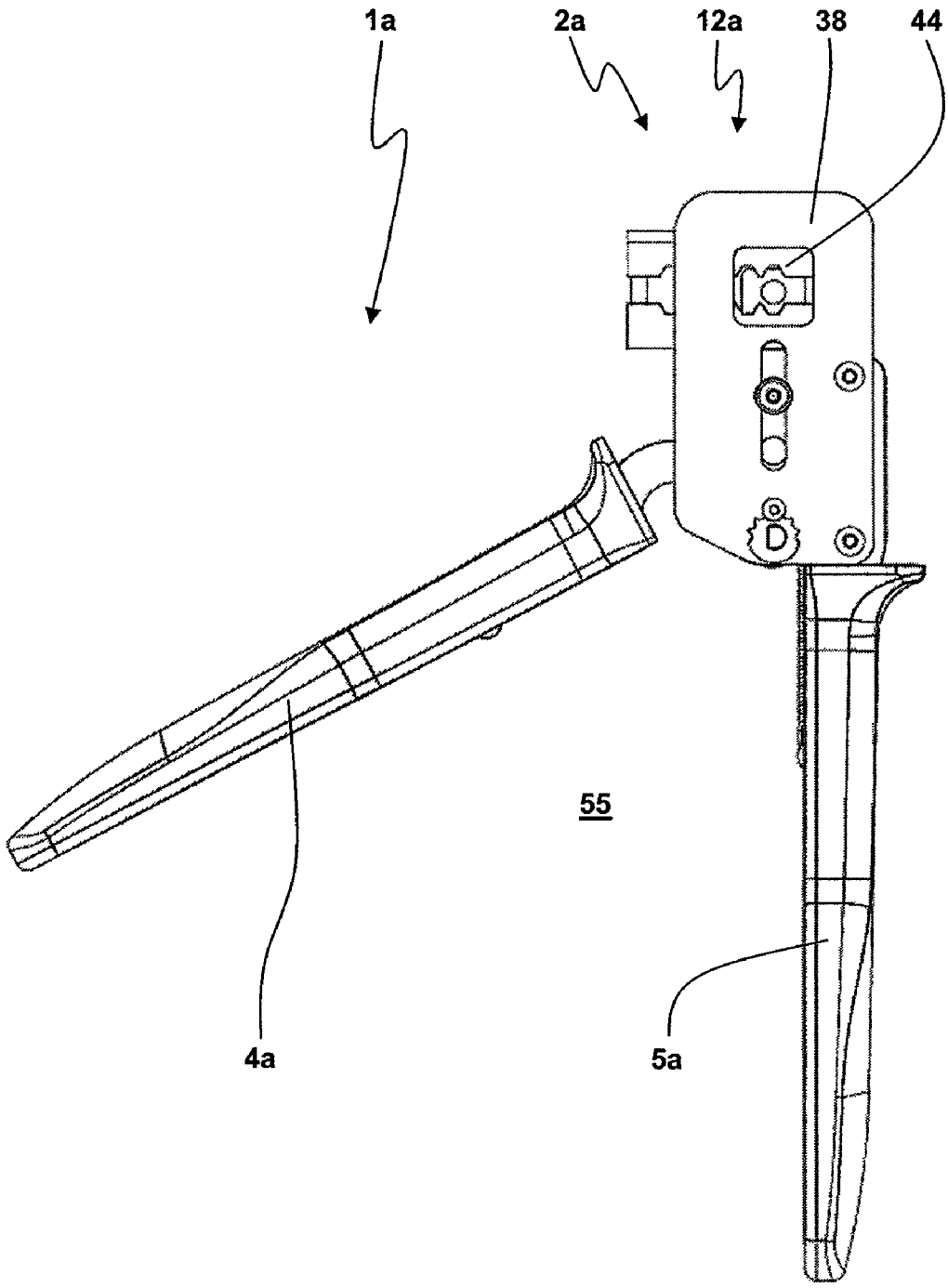
FIG. 6 is a plain view of another embodiment of crimping pliers with a head according to the invention in an open state.
Figure 7:
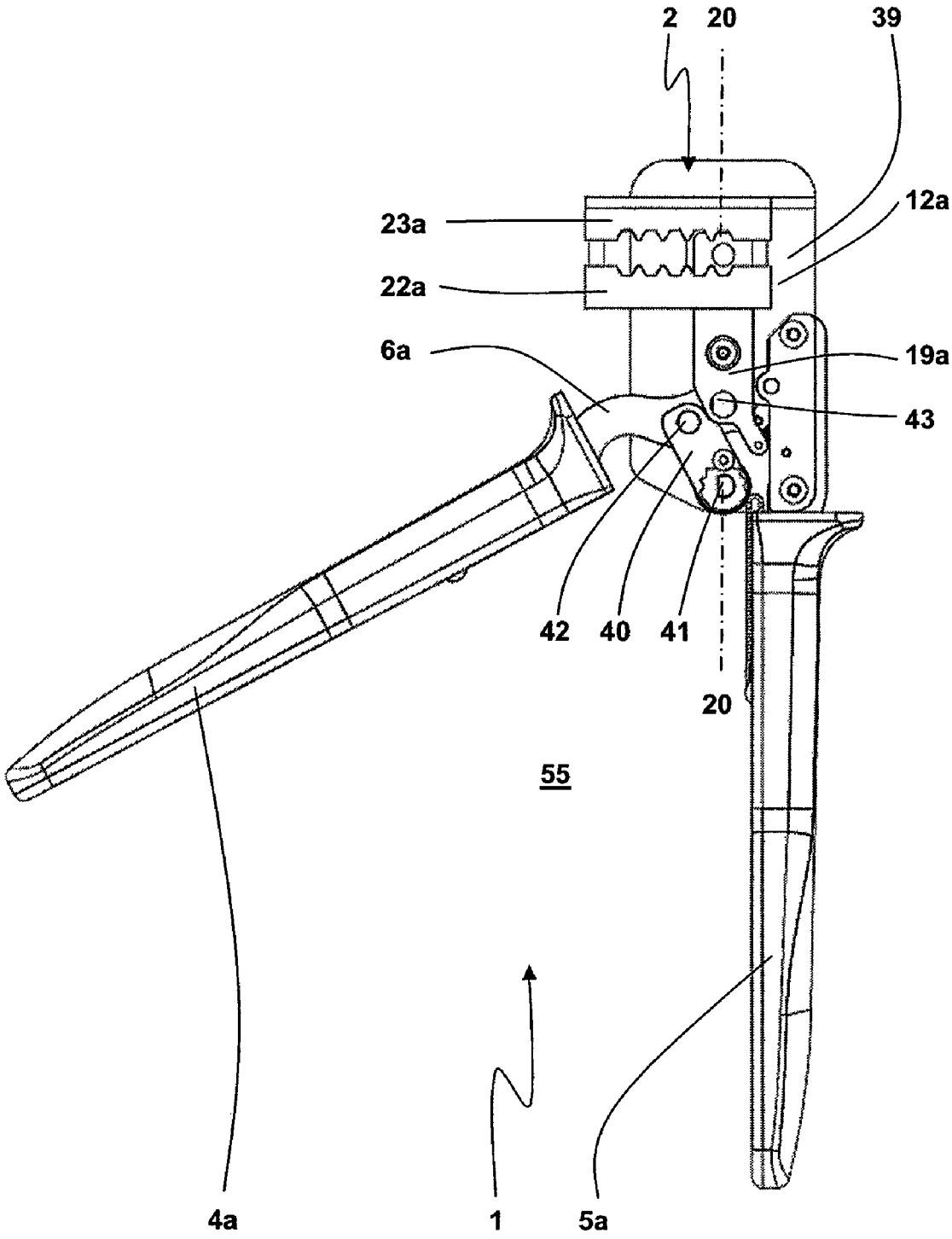
FIG. 7 is a plain view of the crimping pliers according to FIG. 6 in an open state with a covering plate of the crimping pliers being removed.
Figure 8:
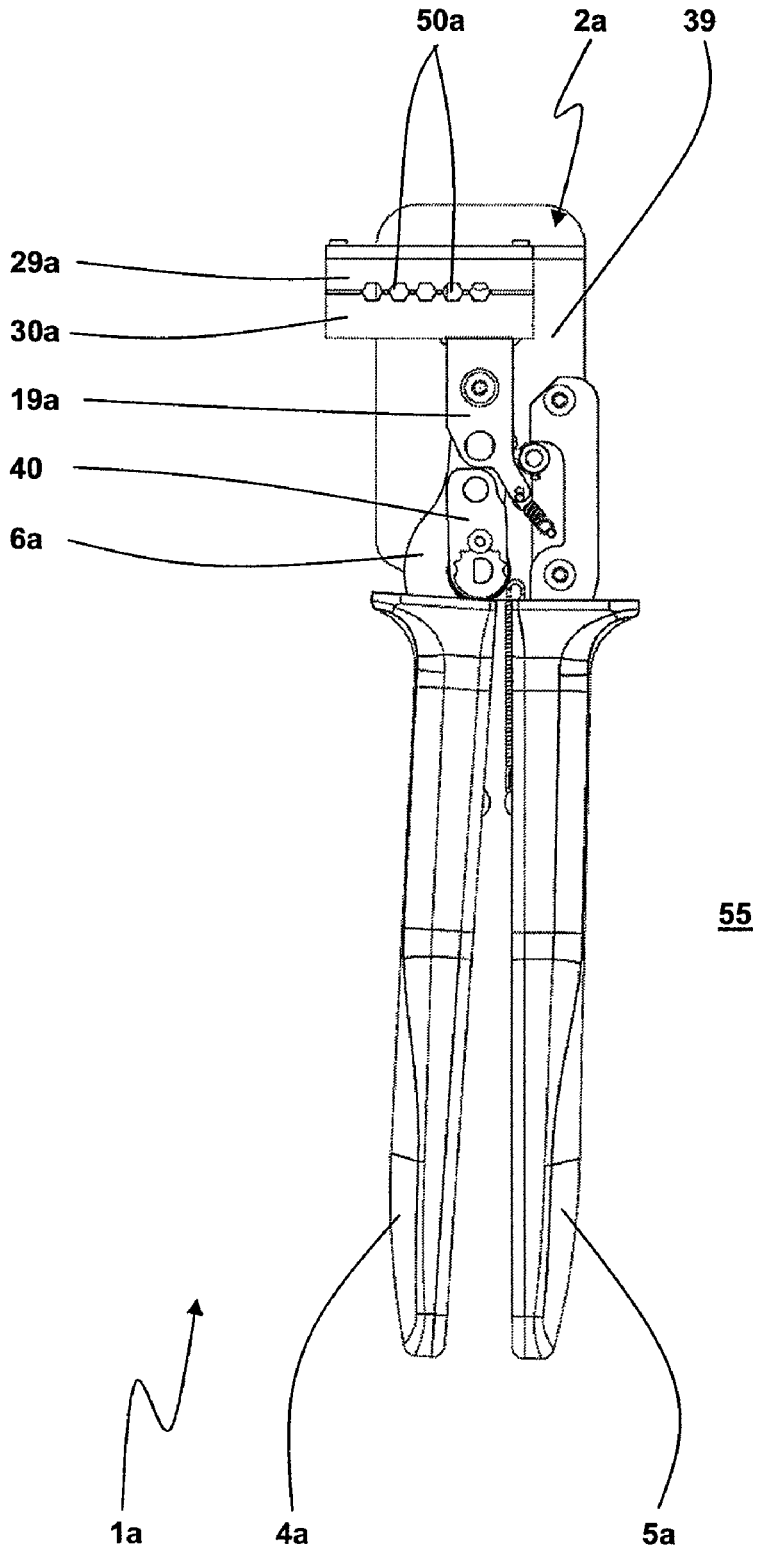
FIG. 8 is a plain view of the crimping pliers according to FIGS. 6 and 7 in a partially disassembled and closed state.

FIGS. 6 to 8 show crimping pliers 1*a* having a head 2*a* built with a frame 12*a* being in a first approximation O-shaped and being built with two O-shaped covering plates 28, 38. The upper covering plate 38 has been removed in the disassembled state shown in FIG. 7. As can be seen from FIG. 7, the hand lever 5*a* is fixedly linked with the frame 12*a*. The hand lever 4*a* is pivotably linked with an elbowed linking region 6*a* via a pressure rod 40 with the frame 12*a*. One end region of the pressure rod 40 is pivotably linked at the frame 12*a* by a bolt 41. The opposite end region of the pressure rod 40 is pivotably linked with the linking region 6*a* by a bolt 42. An end region of the linking region 6*a* protruding beyond the bolt 42 is used for pivotably linking the linking region 6*a* by a bolt 43 with the pushing element 19*a*. Similar to the embodiment shown in FIGS. 1 to 5, the pushing element 19*a* is guided for a movement along the longitudinal axis 20-20 with respect to the frame 12. The pushing element 19*a* is rigidly linked with the crimping jaw 22*a*. The other crimping jaw 23*a* is fixedly linked with the frame 12*a*. A pivoting movement of the hand lever 4*a* causes a kind of toggle lever movement. An increasing angle of the pivoting movement causes a decrease of the angle of the pressure rod 40 with respect to the longitudinal axis 20-20. Such movement coincides with a movement of the bolt 43 in upper direction. Such upward movement coincides with a closing movement of the crimping jaws 22*a*, 23*a*. Similar to the embodiment shown in FIGS. 1 to 5, the crimping jaws 22*a*, 23*a* hold inserts 29, 30 with a guidance having a translational degree of freedom along guiding axes 35*a*-35*a*, 36*a*-36*a*. For the crimping pliers la according to FIGS. 6 to 8, the halves 33A are accessible from the front side of the opening 44 of the O-shaped covering plate 38. Accordingly, it is possible to introduce the work piece from said front side into the head of the pliers. However, due to the O-shape the opening 44 is closed in both lateral directions. Along the guiding axes 35*a*-35*a* and 36*a*-36*a*, the head 2*a* builds a through opening between the cover plates 38, 39. The unit built with the inserts 29*a*, 30*a* is introduced into the through opening from the left side and might be moved along the guiding axes 35*a*-35*a* and 36*a*-36*a* through the head 2*a* of the pliers, so that halves 33A to 33E of different contours and cross-sections might be used. However, compared to the embodiment shown in FIGS. 1 to 5, the extension of the head 2*a* transverse to the plane built by the O (see FIG. 6) is smaller than the correlating extension of the C-shaped pliers in the plane of the C in FIG. 1.

Figure 9:
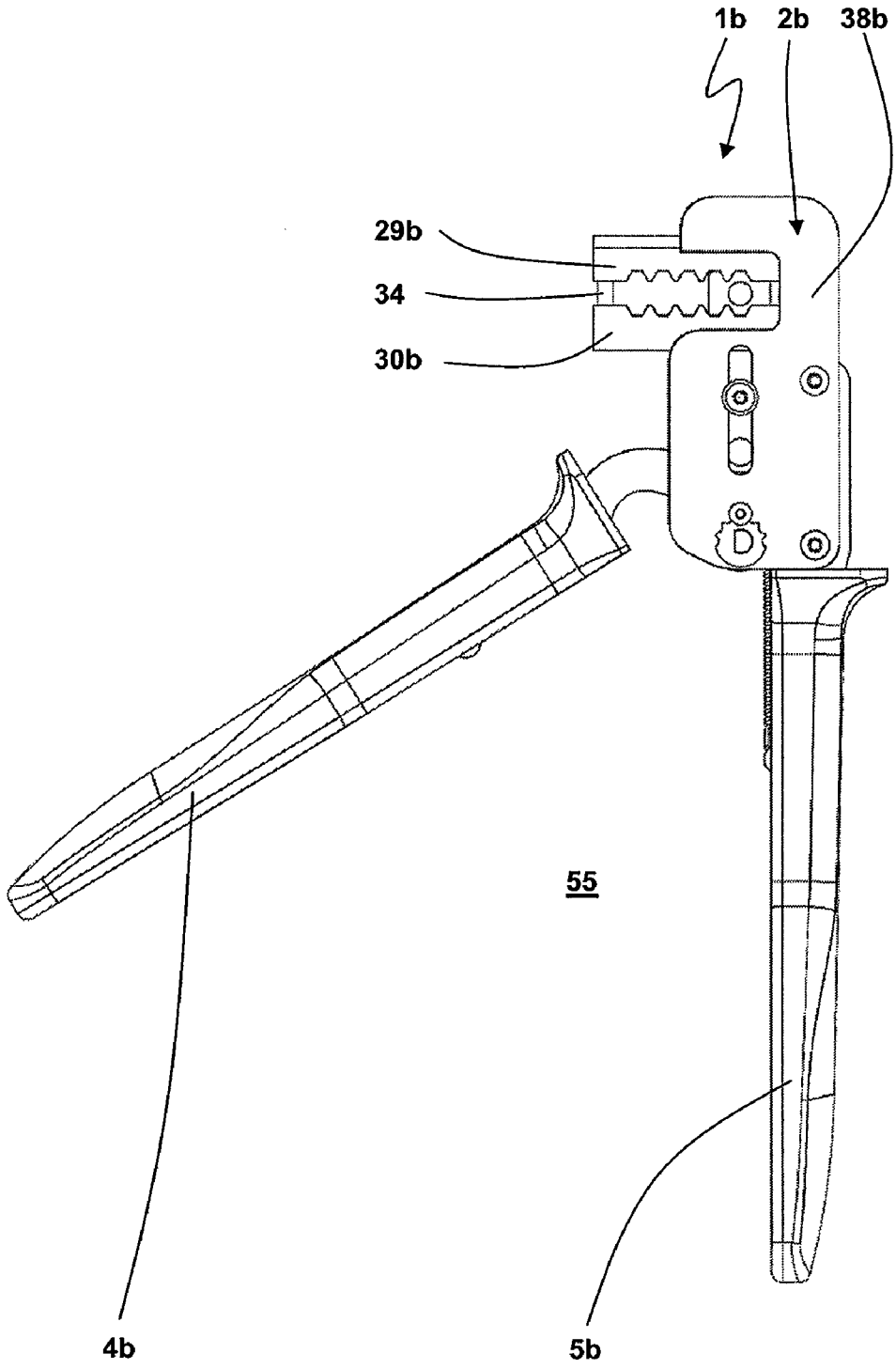
FIG. 9 is a plain view of another embodiment of crimping pliers with a head according to the invention in an open state.
Figure 10:
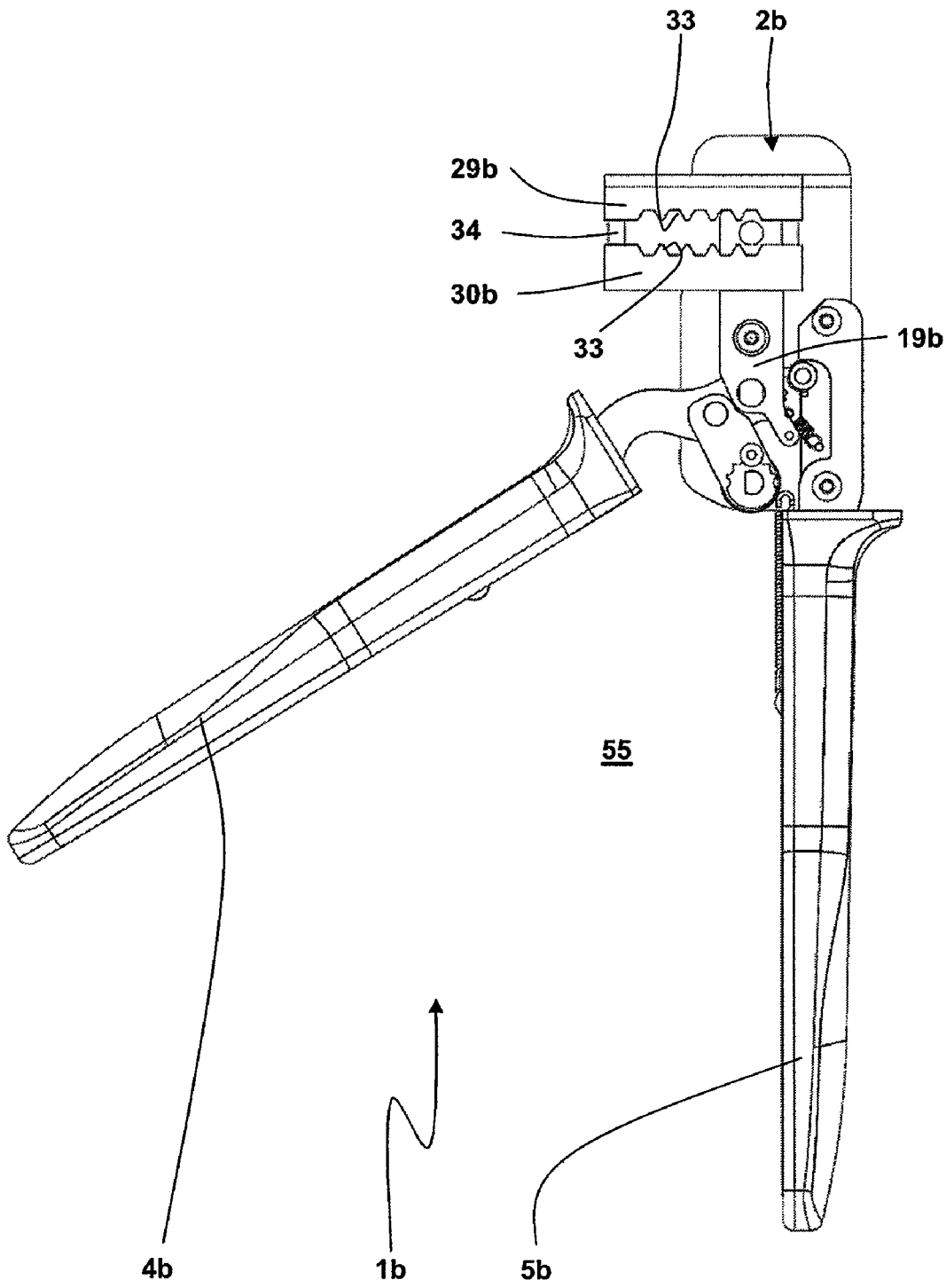
FIG. 10 is a plain view of the crimping pliers according to FIG. 9 in a partially disassembled and open state.

FIGS. 9 and 10 show a third embodiment of crimping pliers 1*b* having a transfer or transmission mechanism similar to the embodiment shown in FIGS. 6 to 8. However, for this embodiment the cover plates 38*b*, 39*b* are not O-shaped but approximately C-shaped. Differing from the embodiment shown in FIGS. 1 to 5, the C is lying in the plane 55 defined by the pivoting movement of the hand levers 4*a*, 5*b*. For such embodiment, the inserts 29*b*, 30*b* are guided by the crimping jaws 22*b*, 23*b* in the region of the two transverse legs of the C.

Figure 11:
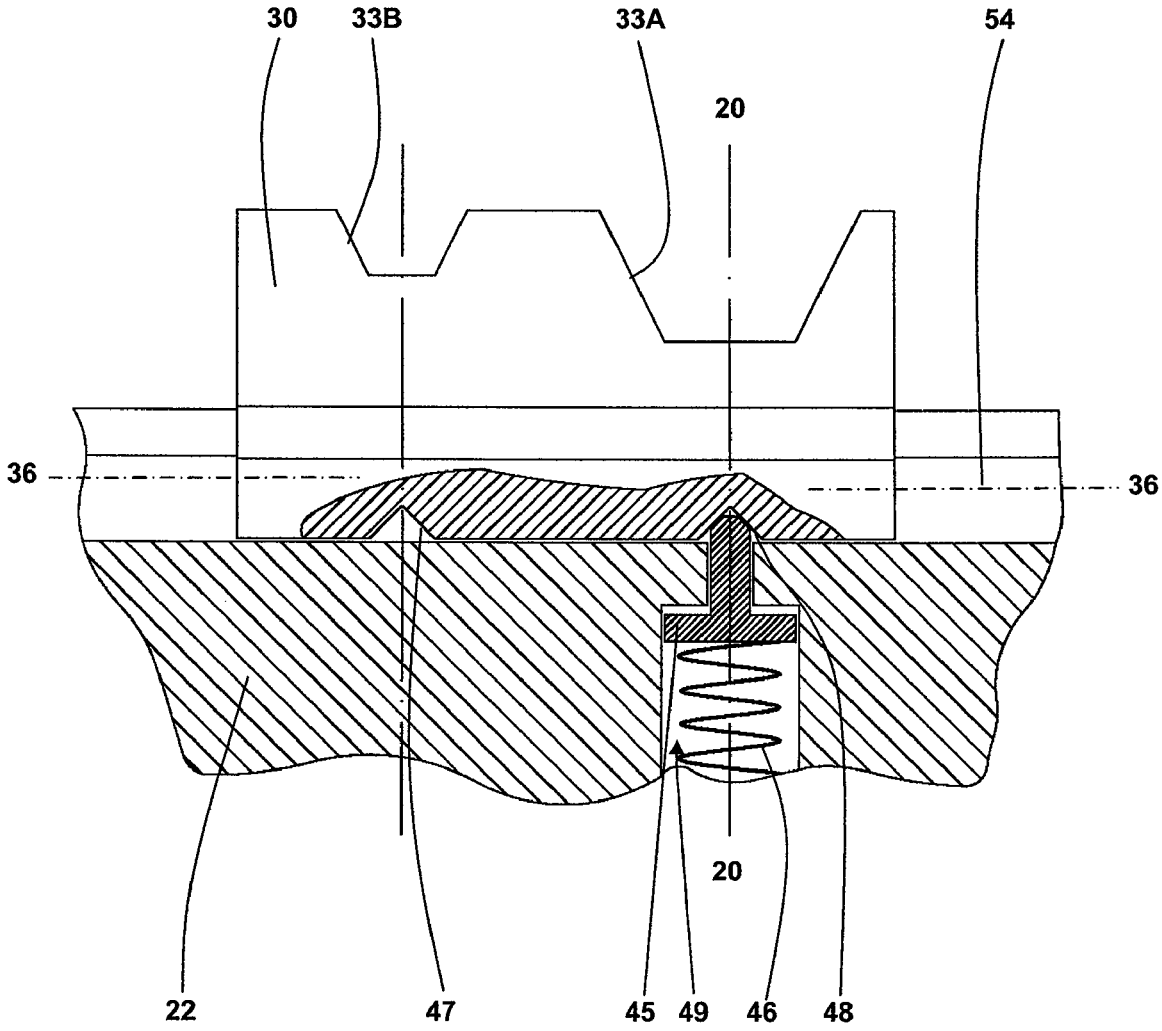
FIG. 11 shows one embodiment of a resting or latching unit for defining operational states of an insert relative to a related crimping jaw.

FIG. 11 shows a schematic sketch of a guiding and resting or locking unit for the insert 30 and the related crimping jaw 22 with a guiding groove 54. In a bore having an orientation transverse to the guiding axis 36-36 a resting element 45 is housed. The resting element 45 is pressed versus the insert 30 by a spring element 46. The insert 30 in the shown embodiment having two nests 50 with two halves 33A, 33B has two resting cavities 47, 48, wherein the distance of the resting cavities 47, 48 corresponds to the distance of the halves 33A and 33B. The resting cavities 47, 48 have a position such that an engagement between the resting element 45 with a resting cavity 47 occurs for the half 33 being located on the longitudinal axis 20-20. For the shown embodiment, the resting element 45 has a centric position, so that also the resting cavity 47 is located at the center of the halves 33. However, it is also possible that the resting element is located with an offset to the center with the consequence that the resting cavities 47 are also located with an offset from the center axis of the halves 33.

In FIGS. 1, 4, 6, 7, 8, 9, 10 the drawing plane correlates with a plane 55, wherein the hand levers 4, 5 are pivoted.

Many variations and modifications may be made to the preferred embodiments of the invention without departing substantially from the spirit and principles of the invention. All such modifications and variations are intended to be included herein within the scope of the present invention, as defined by the following claims.

We claim:

1. A head of crimping pliers for crimping a work piece, comprising:

a) an upper insert and a lower insert, each of said inserts forming at least two halves of at least two nests for the work piece, said nests being designed and arranged for crimping said work piece, wherein said inserts are directly supported against each other in a direction transverse to a crimping axis, b) two crimping jaws supporting said inserts at least in crimping direction and being moved versus each other throughout the crimping movement, c) wherein ca) a first nest of said nests is operating in a first relative position of said inserts with respect to said crimping jaws and cb) a second nest of said nests is operating in a second relative position of said inserts with respect to said crimping jaws, cc) said second relative position differing from said first position, d) said inserts being guided together along a guiding axis for a sliding movement between said first and second relative positions, said guiding axis being directed transverse to said crimping axis.

2. The head of claim 1, wherein said first and second relative positions of said first nest and said second nest are located approximately in the same position along said guiding axis.

3. The head of claim 2, wherein a) said crimping jaws are activated by forces symmetrical to a symmetry axis and b) the positions of said first nest in said first relative position and said second nest in said second relative position are lying on said symmetry axis.

4. The head of claim 1, wherein in said first and second relative positions the inserts have a sliding degree of freedom transverse to said crimping axis.

5. The head of claim 1, wherein said inserts are secured in said first and second relative positions by a fixing device.

6. The head of claim 5, wherein said fixing device is a mounting device.

7. The head of claim 5, wherein said fixing device is a resting, snapping or latching device.

8. The head of claim 5, wherein said fixing device is a locking device.

9. The head of claim 1, wherein hand levers are moved in a plane and said guiding axes have an orientation parallel to said planes.

10. The head of claim 1, wherein at least one of said inserts has a protrusion and at least one crimping jaw has a groove, said protrusion being housed in said groove for a sliding movement along said guiding axis.

11. The head of claim 1, wherein at least one of said crimping jaws has a protrusion and at least one of said inserts has a groove, said protrusion being housed in said groove for a sliding movement along said guiding axis.

12. The head of claim 10, wherein said protrusion has an approximately T-shaped cross-section and said groove has a corresponding T-shaped cross-section.

13. The head of claim 11, wherein said protrusion has an approximately T-shaped cross-section and said groove has a corresponding T-shaped cross-section.

14. The head of claim 1, wherein a plurality of sets of said inserts comprising nests with differing contours or cross-sections is provided.

15. The head of claim 1, wherein the head comprises a mouth being open in lateral direction and said inserts are introduced in lateral direction into said mouth.

16. The head of claim 15, wherein the head in a first approximation has a C-shape, hand levers are moved in a plane, said T-shape being located in said plane and said inserts being introduced into the head transverse to a longitudinal axis of the head and within said plane or parallel to said plane.

17. The head of claim 1, wherein said inserts comprise recesses having an orientation parallel to said crimping axis and at least one guiding bolt is provided, said guiding bolt being located in one of said recesses for directly supporting said inserts against each other.

18. The head of claim 1, said crimping jaws being designed and arranged for being moved with a translational relative degree of freedom.

* * * * *